United States Patent [19]

Frangatos

[11] 4,295,982

[45] Oct. 20, 1981

[54] SULFURIZED AMINOGUANIDINE REACTION PRODUCT AND LUBRICANT COMPOSITIONS CONTAINING SAME

[75] Inventor: Gerassimos Frangatos, Haddonfield, N.J.

[73] Assignee: Mobil Oil Corporation, New York, N.Y.

[21] Appl. No.: 148,898

[22] Filed: May 12, 1980

[51] Int. Cl.[3] ..... C10M 1/38

[52] U.S. Cl. ..... 252/42; 252/34; 252/46.7; 252/47.5; 260/132

[58] Field of Search ..... 252/47.5, 46.7, 34, 252/42; 260/132

[56] References Cited

U.S. PATENT DOCUMENTS

| | | | |
|---|---|---|---|
| 1,830,970 | 11/1931 | Sullivan, Jr. | 252/34 |
| 2,206,151 | 7/1940 | Bennett | 252/46.7 X |
| 2,263,562 | 11/1941 | Bigelow et al. | 260/132 |
| 2,613,205 | 10/1952 | Hill | 252/46.7 X |
| 2,666,745 | 1/1954 | Mullen, Jr. et al. | 260/132 X |
| 2,911,368 | 11/1959 | Fowler et al. | 252/47.5 X |
| 3,655,560 | 4/1972 | Andress, Jr. | 252/51.5 R X |
| 3,749,702 | 7/1973 | Boehringer et al. | 252/34 X |
| 3,790,478 | 2/1974 | Rudston et al. | 252/34 |
| 3,923,668 | 12/1975 | Johnston | 252/34 X |

*Primary Examiner*—Andrew Metz

*Attorney, Agent, or Firm*—Charles A. Huggett; Michael G. Gilman; Claude E. Setliff

[57] ABSTRACT

Products from aminoguanidines or their salts, monocarboxylic acids and sulfur and their use as anti-rust and anti-corrosion additives are covered herein.

10 Claims, No Drawings

SULFURIZED AMINOGUANIDINE REACTION PRODUCT AND LUBRICANT COMPOSITIONS CONTAINING SAME

BACKGROUND OF THE INVENTION

1. Field of the Invention

The invention relates to new products and to lubricants containing same. They are made by (1) reacting an aminoguanidine or its salt with an unsaturated monocarboxylic acid and (2) reacting the product of (1) with sulfur.

2. Discussion of the Prior Art

It is well known that, under certain conditions, metal parts being lubricated will rust. That is to say, when certain types of materials that are normally susceptible to deterioration by oxidation or by corrosion come into contact with various organic media, rust may form. Organic compositions in both the liquid and solid form can induce such corrosion or oxidation. For example, it is known that liquid hydrocarbons in the form of various fuel oils, such as petroleum distillate hydrocarbon fuels, lubricating oils, or greases therefrom, tend to accumulate considerable quantities of water when maintained for long periods of time in storage vessels; and when subsequently brought into contact with metal surfaces in their functional environments, deterioration of said surfaces as a result of rust and corrosion occurs. In addition, where such lubricating oils are incorporated into lubricants in the form of greases, similar deleterious results are encountered.

Many materials have been advanced for use as rust inhibiting additives to organic compositions. Several of these involve compounds comprising a nitrogen atom, such as the glyoxalidines (U.S. Pat. No. 2,668,100) and the like. Furthermore, amines such as the alkanolamines have been disclosed as being anti-rust agents per se. No known art, however, suggests that an effective product can be made by the reaction of materials to be set forth in detail hereinafter.

SUMMARY OF THE INVENTION

In accordance with the invention, there is provided a product obtained by (1) reacting an aminoguanidine or its salt with an unsaturated monocarboxylic acid and (2) reacting the product of (1) with sulfur. The invention further provides lubricant compositions, including emulsifiable lubricant compositions, containing the products.

DESCRIPTION OF SPECIFIC EMBODIMENTS

One of the products effective in this invention has the formula

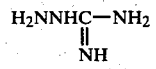

Aminoguanidine

As hereinabove indicated, acid salts of the aminoguanidine are also effective intermediates to make the products of this invention. These include, for example aminoguanidine salts wherein the anion may be the bicarbonate, hydrogen sulfite, monohydrogen orthophosphate, dihydrogen orthophosphate, monohydrogen citrate, dihydrogen citrate, hydrogen fumarate or the hydrogen oxalate ion.

These guanidines, which are readily available from commercial sources or can be readily prepared by mixing in the indicated stoichiometry the corresponding polybasic acid with the aminoguanidine base, are then reacted with a monocarboxylic acid of the formula

R—CHCOOH wherein R is an alkenyl group, an alkedienyl group or an alketrienyl group containing 2 to 50 carbon atoms. That is to say, the R groups will contain, one, two or three double bonds. As specific illustrations of the useful acids, there may be mentioned myristoleic acid, palmitoleic acid, oleic acid, linoleic acid, linolenic acid, elaidic acid, brassidic acid, linolelaidic acid, arachidonic acid, abietic acid and the like.

The reaction between the aminoguanidine and acid is a condensation reaction. In carrying it out, stoichiometric amounts are preferred. The temperature will range from about 150° C. to about 275° C., preferably from about 170° C. to about 225° C. Optimum yield will be obtained at these temperatures in from about 1 hour to about 8 to 10 hours.

Following completion of the reaction with the unsaturated acid, the product is then reacted with elemental sulfur at temperatures of from about 150° C. to about 225° C. Although it is known that the product obtained is complex and that it varies according to the temperatures used, the exact structure is not known. However, the sulfurization probably proceeds in accordance with the well known facts that attack occurs at the double bond at 150° C. or below and at the allylic positions at temperatures of from about 180° C. to about 200° C.

It has been found that attack by sulfur at the allylic position gives a more active rust inhibitor. It is known that this more desirable derivative can be prepared at a lower temperature by using dimethylformamide or other polar solvent such as dimethylsulfoxide. Such solvents not only moderate the temperature, but they also direct the sulfur attack to the allylic position.

Further, in carrying out the reaction, a stoichiometric amount of sulfur is preferred, but a small excess thereof may be employed if desired.

The lubricants which may be improved by such condensation products are mineral and synthetic lubricating oils and greases made therefrom. The mineral oils will be understood to embrace not only the paraffinic, but also the naphthenic members. By synthetic oils are meant synthetic hydrocarbons, polyalkylene oxide oils, polyacetals, polysilicones and the like, as well as synthetic ester oils. Of the latter type, there may be mentioned those esters made from monohydric alcohols and polycarboxylic acids, such as 2-ethylhexyl azelate and the like, and those made from polyhydric alcohols and aliphatic monocarboxylic acids. Those of this group are especially important, and they include esters prepared from the trimethylols, such as the ethane, propane and butane derivatives thereof, 2,2-disubstituted propane diols and the pentaerythritols with aliphatic monocarboxylic acids containing from about 4 to about 9 carbon atoms. Mixtures of these acids may be used to prepare the esters. Preferred in the practice of this invention are the esters prepared from a pentaerythritol and a mixture of $C_5$-$C_9$ acids. In making such esters, a generally acceptable product can be made from commercial pentaerythritol containing about 88% of monopentaerythritol and 12% dipentaerythritol.

The following will specifically illustrate the invention. It will be understood that the matter is intended only for illustrative purposes, and is in no way to be construed as limiting the invention.

EXAMPLE 1

Oleic acid (56.4 g., 0.2 mole), aminoguanidine bicarbonate (27.2 g., 0.2 mole) and xylene (150 ml) were placed in a flask. The reaction mixture was kept under a nitrogen atmosphere and was brought to reflux temperature with stirring. The water formed throughout the 2-hour reaction course (3.6 ml) was collected in the attached water trap. When the theoretical quantity of water (3.6 ml, 0.2 mole) was collected, further refluxing failed to produce additional water. The solvent was stripped under reduced pressure, leaving a clear fluid residue weighing 68 g.

EXAMPLE 2

Oleic acid (28.25 g., 0.1 mole), aminoguanidine bicarbonate (13.6 g., 0.1 mole) and xylene (150 ml) were mixed in a flask. The reaction mixture, initially heterogeneous, was brought to reflux temperature with stirring and continual nitrogen flow over the surface of the mixture. Water (1.8 ml) was collected in the attached water trap. The solvent and any solubles present in the reaction mixture were distilled under reduced pressure. The final temperature in the flask was 190° C. The residue was a dark, viscous fluid. The yield was 32 g.

EXAMPLE 3

Twenty-two grams of the product of Example 2 and 4 g. of sulfur were placed in a flask containing 50 ml of dimethyl formamide and were heated, whereupon the mixture darkened. The dark solution was brought to reflux temperature, and $H_2S$ began to evolve. Stirring and refluxing were continued, while supplying a light flow of nitrogen to the flask, for 1 hour. The solvent and any volatiles were distilled off under reduced pressure, the final pot temperature being 160° C. The yield of product was 25 g.

EVALUATION OF THE PRODUCTS

Rust Test

The test used was ASTM D 1743 modified as follows:

Test duration: 24 hours

Additive concentration: 5% by weight

Distilled water replaced with 5% synthetic sea water.

The results, using a grease comprising a blend of refined naphthenic and paraffinic mineral oils, thickened with 8.5% by weight of lithium hydroxystearate soap to an $NLGT_2$ constancy, and also containing minor amount of antioxidant, antiwear, extreme pressure and metal deactivator additives, but no rust inhibitor in Composition 1, are shown in Table 1.

TABLE 1

| Composition | Additive of Example | % Wt. of Additive | Estimated % of Surface Rusted | D1743 Rating |
|---|---|---|---|---|
| 1 | | 0 | 10;15 | 3;3* |
| 2 | 1 | 5 | —;—** | 1;2+ |
| 3 | 2 | 5 | 1;5 | 3;3 |
| 4 | 3 | 5 | —**;1 | 1;3 |

*Grease only

**Indicates no rust

In the table, the ratings were determined according to the following scale:

1 = a bearing showing no corrosion

2 = a bearing showing no more than three spots of a size just sufficient to be visible to the naked eye 3 = a bearing having more than three spots

I claim:

1. A product obtained by (1) reacting an aminoguanidine or an acid salt thereof with an unsaturated monocarboxylic acid at a temperature of from about 150° C. to about 275° C. and (2) reacting the product of (1) with sulfur at from about 150° C. to about 225° C.

2. The product of claim 1 wherein the monocarboxylic acid has the formula

R—COOH wherein R is an alkenyl group, an alkedienyl group or an alketrienyl group.

3. The product of claim 1 wherein the aminoguanidine salt contains an anion from the group consisting of bicarbonate, hydrogen sulfite, monohydrogen, orthophosphate, dihydrogen orthophosphate, monohydrogen citrate, dihydrogen citrate, hydrogen fumarate or hydrogen oxalate.

4. The product of claim 1 wherein the aminoguanidine salt is aminoguanidine bicarbonate and the unsaturated acid is oleic acid.

5. A lubricant composition comprising a major proportion of a mineral lubricating oil, a synthetic lubricating oil or a grease from either of these and an anti-rust amount of the product of claim 1.

6. The composition of claim 5 wherein in the product the monocarboxylic acid has the formula

R—COOH wherein R is an alkenyl group, an alkedienyl group or an alketrienyl group.

7. The composition of claim 5 wherein in the product the aminoguanidine salt contains an anion from the group consisting of bicarbonate, hydrogen sulfite, monohydrogen orthophosphate, dihydrogen orthophosphate, monohydrogen citrate, dihydrogen citrate, hydrogen fumarate and hydrogen oxalate.

8. The composition of claim 5 wherein in the product the aminoguanidine salt is aminoguanidine bicarbonate and the unsaturated acid is oleic acid.

9. The composition of claim 5 wherein the lubricant is a grease.

10. The composition of claim 9 wherein the thickener for said grease is a lithium hydroxystearate soap.

* * * * *